US006430873B1

(12) United States Patent
Borchuk et al.

(10) Patent No.: US 6,430,873 B1
(45) Date of Patent: Aug. 13, 2002

(54) DUAL DRUM AND RAIL WINDOW REGULATOR DRIVE SYSTEM

(75) Inventors: Ken C. Borchuk, Brooklyn; Luc R. Regnier, Toronto, both of (CA)

(73) Assignee: Atoma International Corporation, Newmarket (CA)

( * ) Notice: Subject to any disclaimer, the term of this patent is extended or adjusted under 35 U.S.C. 154(b) by 0 days.

(21) Appl. No.: 09/520,559

(22) Filed: Mar. 8, 2000

(51) Int. Cl.[7] ..... E05F 11/48
(52) U.S. Cl. ..... 49/352; 49/348
(58) Field of Search ..... 49/348, 349, 352, 49/374, 375; 74/89.2, 89.22, 505, 506; 242/54, 342, 289, 302; 296/146.2, 146.8

(56) References Cited

U.S. PATENT DOCUMENTS

| | | | | | |
|---|---|---|---|---|---|
| 449,176 | A | * | 3/1891 | Rohlf | |
| 2,336,530 | A | * | 12/1943 | Chandler et al. | 49/425 |
| 2,555,859 | A | * | 6/1951 | Rappl et al. | |
| 2,617,315 | A | * | 11/1952 | McClelland | |
| 3,566,540 | A | * | 3/1971 | Hewitt | |
| 3,659,466 | A | | 5/1972 | Pickles | |
| 3,706,236 | A | * | 12/1972 | Pickles | 74/89.11 |
| 4,119,341 | A | * | 10/1978 | Cook | 296/146 |
| 4,143,556 | A | | 3/1979 | Hauber | |
| 4,170,847 | A | * | 10/1979 | Pickles | 49/349 |
| 4,173,845 | A | | 11/1979 | Heesch | |
| 4,191,060 | A | * | 3/1980 | Sessa | 74/89.22 |
| 4,235,117 | A | * | 11/1980 | Pickles | 74/89.2 |
| 4,428,542 | A | * | 1/1984 | Kobayashi et al. | 242/54 R |
| 4,440,354 | A | * | 4/1984 | Kobayashi et al. | 242/54 R |
| 4,631,864 | A | * | 12/1986 | Barros | 49/352 |
| 4,793,099 | A | * | 12/1988 | Friese et al. | 49/380 |
| 4,970,827 | A | * | 11/1990 | Djordjevic | 49/349 |
| 6,052,946 | A | * | 4/2000 | Isomura | 49/352 |
| 6,052,947 | A | * | 4/2000 | Smith | 49/352 |
| 6,061,963 | A | * | 5/2000 | Osborn et al. | 49/352 |
| 6,073,395 | A | * | 6/2000 | Fenelon | 49/358 |
| 6,145,252 | A | * | 11/2000 | Fenelon | 49/349 |

FOREIGN PATENT DOCUMENTS

| | | |
|---|---|---|
| DE | 36 15 578 C | 9/1987 |
| DE | 40 08 229 A | 9/1991 |
| DE | 4 337 693 A | 5/1994 |
| EP | 0 360 911 A | 4/1990 |
| EP | 0 384 219 A | 8/1990 |
| EP | 0 834 634 A1 | 8/1998 |

* cited by examiner

*Primary Examiner*—Curtis A. Cohen
(74) *Attorney, Agent, or Firm*—Clark Hill PLC

(57) ABSTRACT

A window regulator system has a first rail and a second rail. The second rail is spaced in a parallel relation with the first rail. A first slider assembly slidably engages the first rail and a second slider assembly slidably engages the second rail. A first cable engages the first slider and has opposite ends thereof wound about a first drum assembly. The first cable is guidedly mounted on the first rail. A second cable engages the second slider and has opposite ends thereof wound about a second drum assembly. The second cable is guidedly mounted on the second rail. A drive system simultaneously rotates the first and second drum assemblies. Rotating the first and second drum assemblies effects parallel movement of the first and second sliders. When a window is mounted on the sliders, the window regulator system effects opening and closing thereof.

19 Claims, 5 Drawing Sheets

DUAL DRUM AND RAIL WINDOW REGULATOR DRIVE SYSTEM

FIELD OF INVENTION

This invention relates to a window regulator for large sized glass panels. In particular, this invention relates to a dual drum and rail window regulator for raising and lowering large glass panels.

BACKGROUND OF INVENTION

In older styled station wagon vehicles, the rear window is mounted on a window regulator assembly allowing the window to be moved up and down, opening and closing the rear of the vehicle. However, the station wagon is no longer as prominent as a styling base for a vehicle. Currently, minivans and sport utility vehicles dominate vehicle production.

Minivans and sport utility vehicles are commonly provided with a liftgate which is hingedly mounted at the upper rear of the vehicle. The liftgate swings in a rearwardly and upwardly path. Alternatively, the window pane by itself is hingedly mounted for swinging open and closed.

The size of the rear window for minivans and sport utility vehicles are relatively large in comparison with side windows. Conventional window regulators have been found to be not durable enough to lift a large weighty window glass over the life of the vehicle. It is possible to increase the durability of the window regulator by making it "heavy duty". However, a "heavy duty" regulator adds weight to the vehicle which is undesirable. As a result, minivans and sport utility vehicles have been limited to hinged style rear windows.

SUMMARY OF INVENTION

The disadvantages of the prior art may be overcome by providing a dual drum and cable window regulator system capable of repeatedly lifting and lowering a relatively large window glass while maintaining parallelism of the glass.

According to one aspect of the invention, there is provided a window regulator system having a first and a second rail. The second rail is spaced in a parallel relation with the first rail. A first slider assembly slidably engages the first rail and a second slider assembly slidably engages the second rail. A first cable engages the first slider and has opposite ends thereof wound about a first drum. The first cable is guidedly mounted on the first rail. A second cable engages the second slider and has opposite ends thereof wound about a second drum. The second cable is guidedly mounted on the second rail. A drive system simultaneously rotates the first and second drum. Rotating the first and second drum effects parallel movement of the first and second sliders. When a window is mounted on the sliders, the window regulator system effects parallel opening and closing thereof.

DESCRIPTION OF THE DRAWINGS

In drawings which illustrate the principles of the present invention.

DETAILED DESCRIPTION OF THE INVENTION

Figure 1:
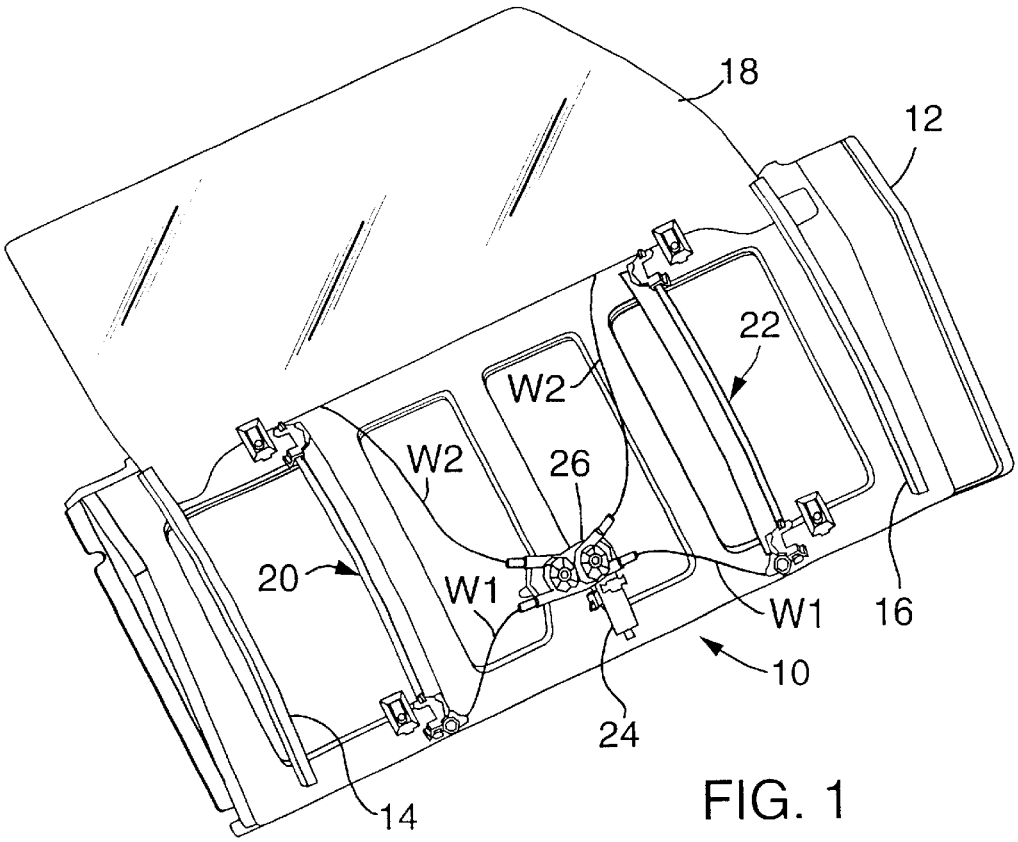
FIG. 1 is a perspective view of a tailgate assembly incorporating a window regulator system of the present invention.

Referring to FIG. 1, there is illustrated a window regulator assembly 10 of the present invention mounted within a vehicle tailgate 12. The tailgate 12 can be of any conventional design and construction defining an interior volume. Th tailgate 12 has a first window channel 14 and a second window channel 16 mounted internally and on opposite sides of the tailgate 12. A rectangular glass panel 18 is slidably mounted within the channels 14 and 16 for guiding the panel 18 during reciprocating up and down movement.

The window regulator system 10 generally comprises a first drum and cable regulator sub-assembly 20 and a second drum and cable regulator sub-assembly 22, a drive actuator 24 and a drive unit 26.

Figure 2:
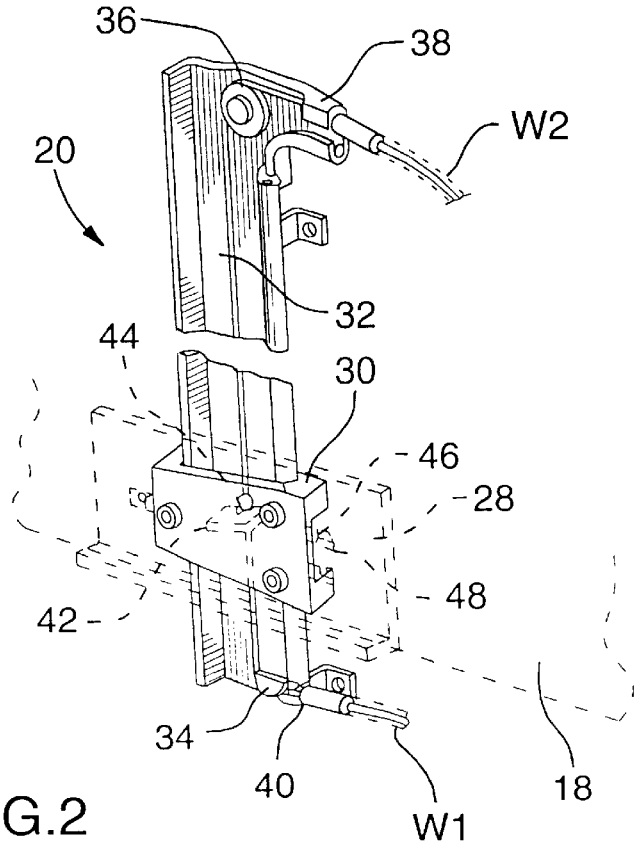
FIG. 2 is a perspective view of a lift plate slider assembly of the window regulator system of FIG. 1.
Figure 3:
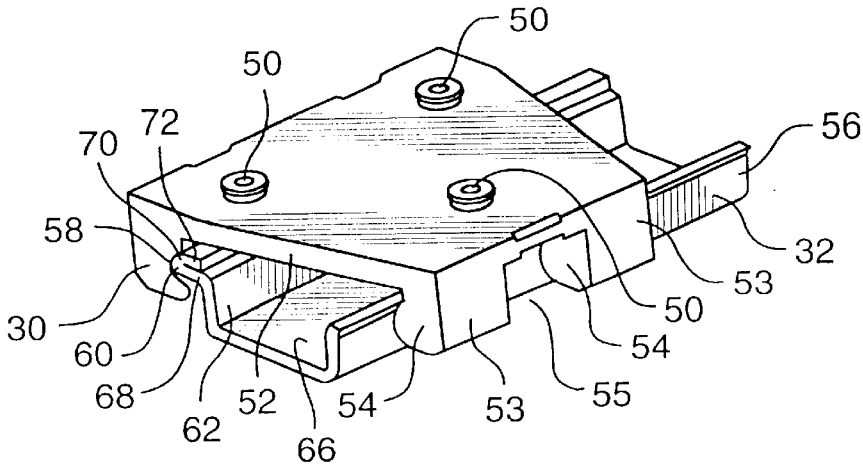
FIG. 3 is a perspective view of the slider of the lift plate slider assembly of FIG. 2.

Referring to FIG. 2, the window regulator sub-assembly 20 includes a lifter plate 28 engaging the lower portion of the window panel 18. A slider member 30 is secured to the lifter plate 28 and mounted for sliding movement along a longitudinal guide rail 32 bolted on the interior of tailgate 12. Together the slider 30 and the lifter plate 28 constitute a window moving structure. The guide rail 18 is preferably steel or aluminum and formed by stamping.

The guide rail 32 has at its lower end a semi-circular guide plate 34 secured thereon for guiding the Bowden cable or wire W1 and at its upper end a guide pulley 36 secured rotatably thereon for guiding the Bowden cable or wire W2. The vertically spaced-apart guide plate 34 and pulley 36 can be referred to as guiding portions and constitute the limits of movement of the lifter plate 28. The guide plate 34 also has a guide openings 38 and 40 for guiding the Bowden wires W1 and W2 toward the drive unit 26.

The slider 30 has a nipple housing 42 which fixedly attaches wire beads 44 fixed to the wire or cable W2. This enables the slider 30 to be slidably driven along guide rail 32 upon movement of wires W1, W2. The wire W1 extends downward from the nipple housing 42 to the semi-circular guide plate 34 and through guide opening 40. The wire W2 extends upward from the nipple housing 42 to the guide pulley 36 around which it extends to the guide opening 38.

The actuator 24 rotates in a first or second rotational direction to effect movement of the wires W1, W2 through the guide tubes. This in turn causes upwards or downwards vertical movement of the slider 30 along the guide rail 32 depending on the direction in which the actuator 24 is rotated.

The lifter plate 28 is secured to the window panel 18 in conventional fashion. The lifter plate 28 has tab members 46 punched through the metal material thereof, which forms openings 48 in the remaining portions of the lifter plate 28.

The slider 30 is preferably molded from a plastic material. It is also provided with a plurality (3) of locating projections 50 constructed and arranged to be received to be received in corresponding holes in the lifter plate 28 for proper alignment between the slider 30 and the lifter plate 28 with the window panel 18 attached thereto.

The slider 30 has a plate-like base 52 having a generally quadrilateral configuration. Four legs 53 extend generally from the corners of the base 52 and define a recess 55 therebetween in which the tab members 46 are received for fixing the lifter plate 28 to the slider 30. The legs 53 of the slider 30 located on one side of the base 52 are provided with inwardly projecting portions 54 which slidably engage the convex exterior surface of side flange 56 of the guide rail 32. The opposite legs 53 disposed on an opposite side of the base 52 are provided with V-shaped grooves 58 defined by a pair of inclined surfaces and which receives a nose portion 60 extending laterally outwardly from the end of a side flange 62 opposite the side flange 56.

The nose portion 60 of the side flange 62 is folded over end portion and includes a longitudinal strip of metal 68 extending laterally outwardly away from the guide rail channel 66 formed by the steel guide rail 32, a rounded end region 70, and a longitudinally extending flat portion 72 disposed in overlying relation with respect to the strip 68.

The second drum and cable regulator sub-assembly 22 is a mirror image of the first drum and cable regulator sub-assembly 20 and thus will not be described in further detail. The rails of the sub-assemblies 20, 22 are mounted to the interior of the tailgate 12 in a spaced parallel relation. The window moving structures of the drum and cable regulator sub-assemblies 20, 22 are connected to opposite end regions of window panel 18.

Figure 4:
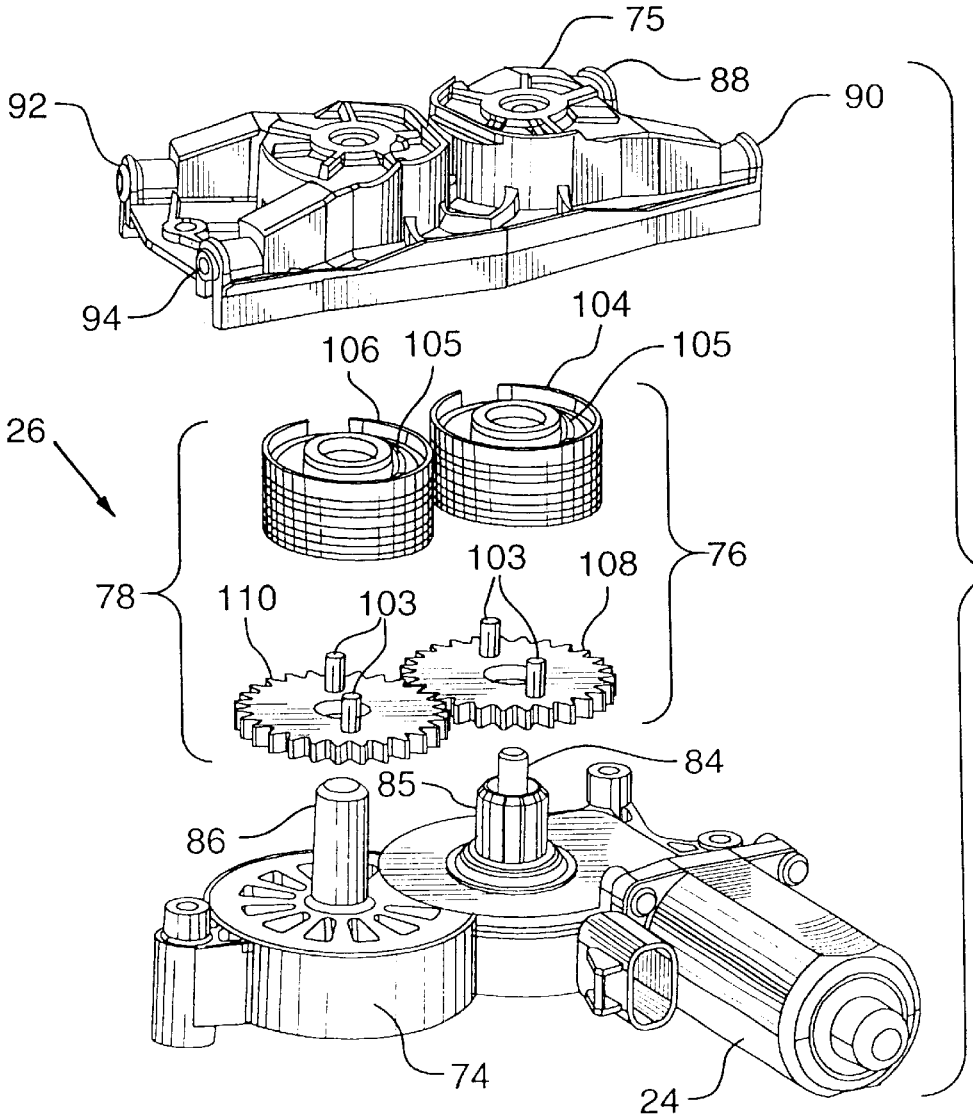
FIG. 4 is an exploded perspective view of the drive unit of the window regulator system of FIG. 1.

Referring to FIG. 4, the drive unit 26 is illustrated in greater detail. Drive unit 26 generally comprises a housing 74, a cover 75, a first drum assembly 76 and a second drum assembly 78. Drive unit 26 is mounted within the tailgate 12 at a suitable structural location.

First and second drum assemblies 76, 78 are identical and generally comprise a barrel portion 104, 106 in driving engagement with a gear 108, 110 by pins 103. Alternatively, drum assemblies 76, 78 could be manufactured as an integral molding. First drum assembly 76 is drivingly mounted on spindle 84 having a rotatably mounted splined collar 85. Second drum assemblies 78 is journal mounted on the spindle 86. The axis of rotation of the drum assemblies 76, 78 are spaced apart and extend parallel to each other.

Actuator 24 has a drive gear. Actuator 24 is mounted relative to the housing 74 in a driving geared relation with the splined collar 85. A drive gear operatively engages a gear mounted within the housing 74 on splined collar 85 for effecting rotation thereof.

Figure 5:
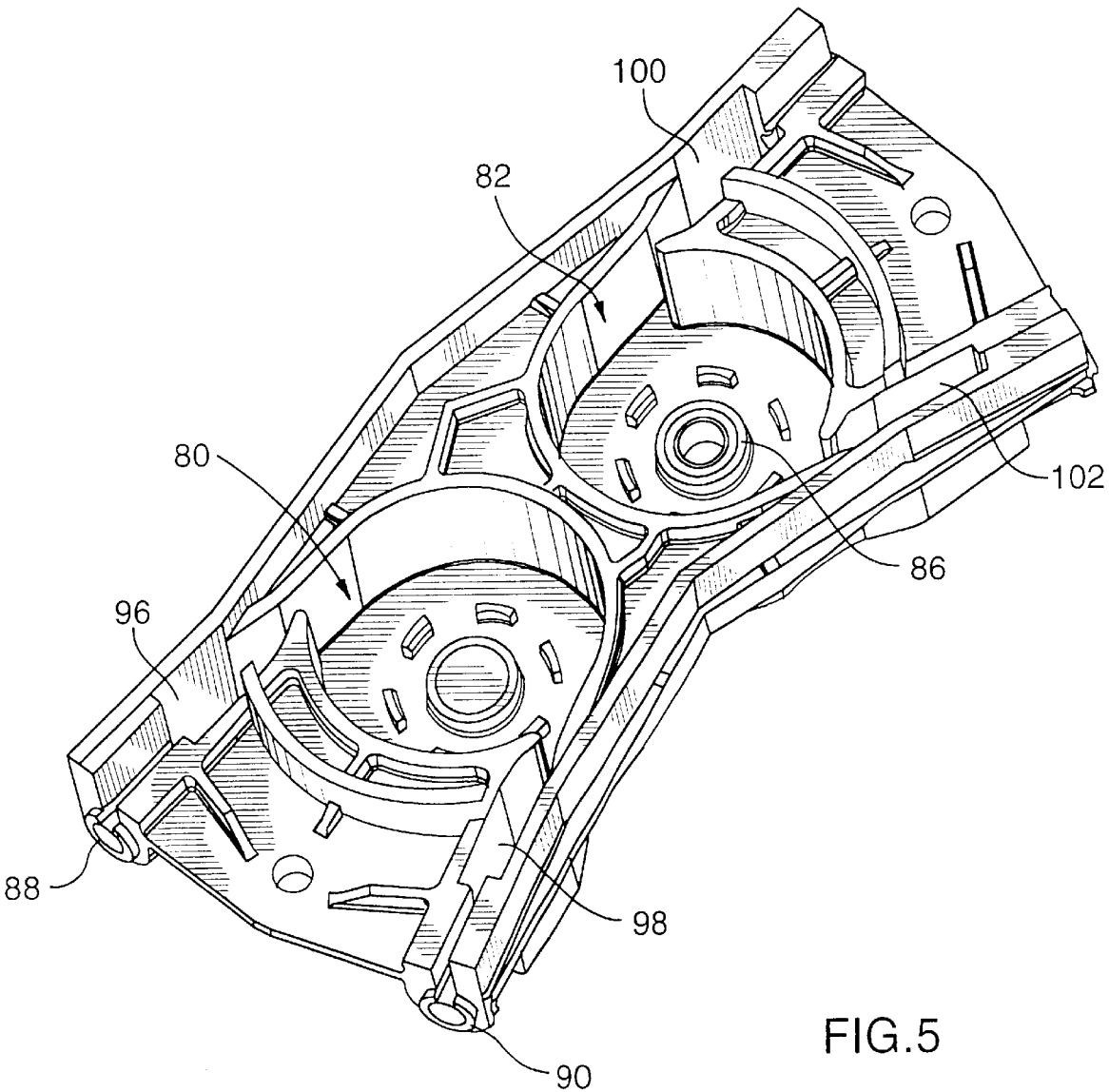
FIG. 5 is a perspective view of the underside of a cover of the drive unit of FIG. 4.
Figure 6:
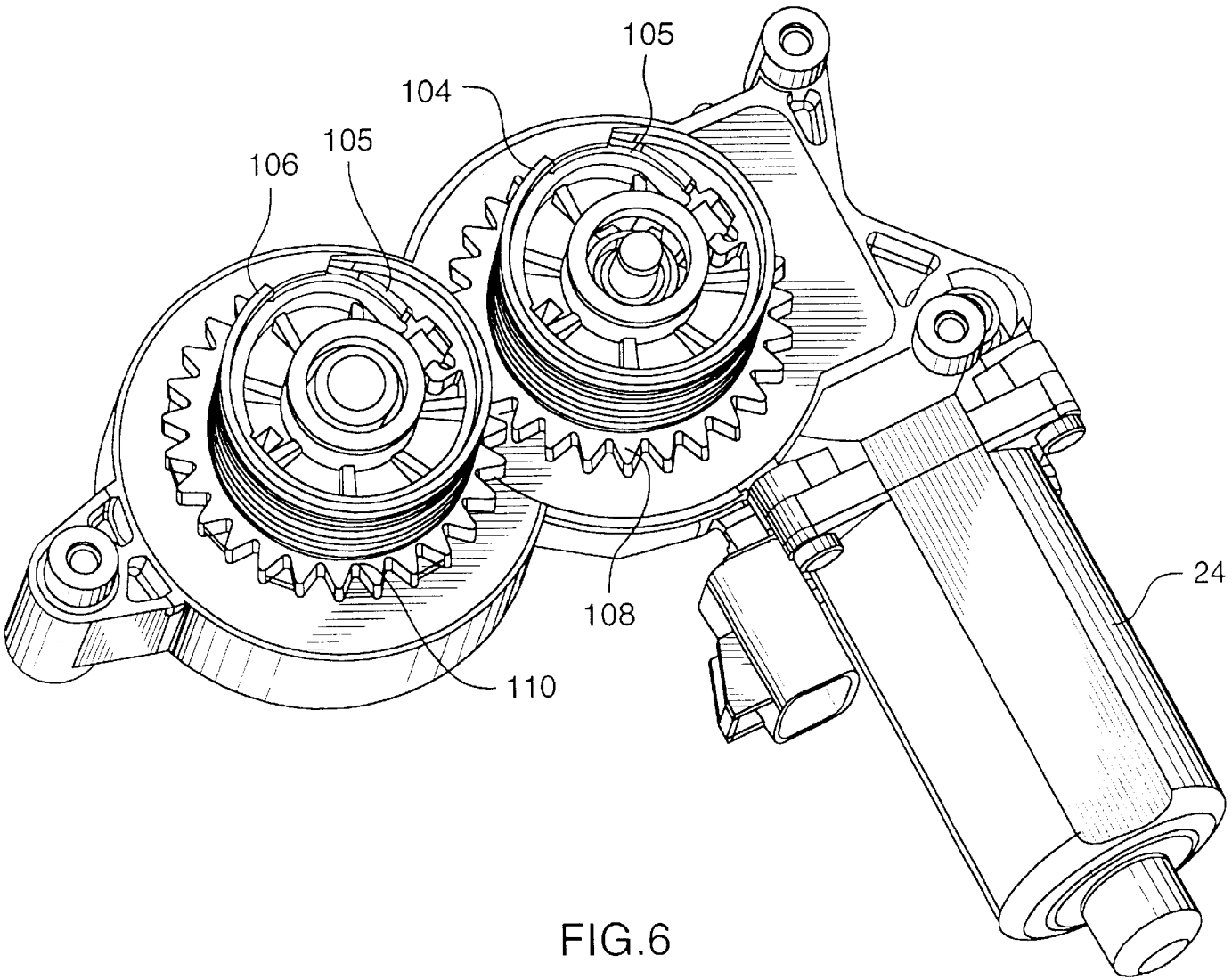
FIG. 6 is a perspective view of the assembled drive unit of FIG. 4, with cover removed.

Referring to FIG. 5, cover 74 has a pair of circular recesses 80, 82. The base of each recess 80, 82 respectively has a circular bore 87, 89. Housing 74 has four cable retainers 88, 90, 92, 94 which communicates with a groove 96, 98, 100, 102 which extends from the respective cable retainer 88, 90, 92, 94 to the respective circular recess 80, 82. Recesses 80, 82 are sized to receive th barrel portions 104, 106 while maintaining gears 108, 110 in geared or driving engagement with each other. Each end surface of the barrel portions 104, 106 has a recess 105 for receiving a respective end of cables W1 and W2. Cables W1 and W2 engage the cable retainers 88, 90, 92, 94 with the ends of the cables wound about the barrel portion 104, 106 and inserted into the recesses 105.

In operation, actuator 24 is energized to rotates drum assemblies 76, 78 in opposite senses. The drum rotation will wind and unwind cables W1 and W2 of each of the window regulator sub-assemblies 20, 22 which effects parallel up and down movement of the sliders 30 and ultimately of the window panel 18.

Providing separate window regulator sub-assemblies 20, 22 with drums and cables, the window regulator assembly 10 of the present invention has increased durability over a single drum and cable system. By utilizing two drums and cables, equal stresses are applied to the cables causing equal stretching of the cables reducing glass movement chuck and tip thereby facilitating substantially parallel and smooth operation of a relatively wide glass panel.

Figure 7:
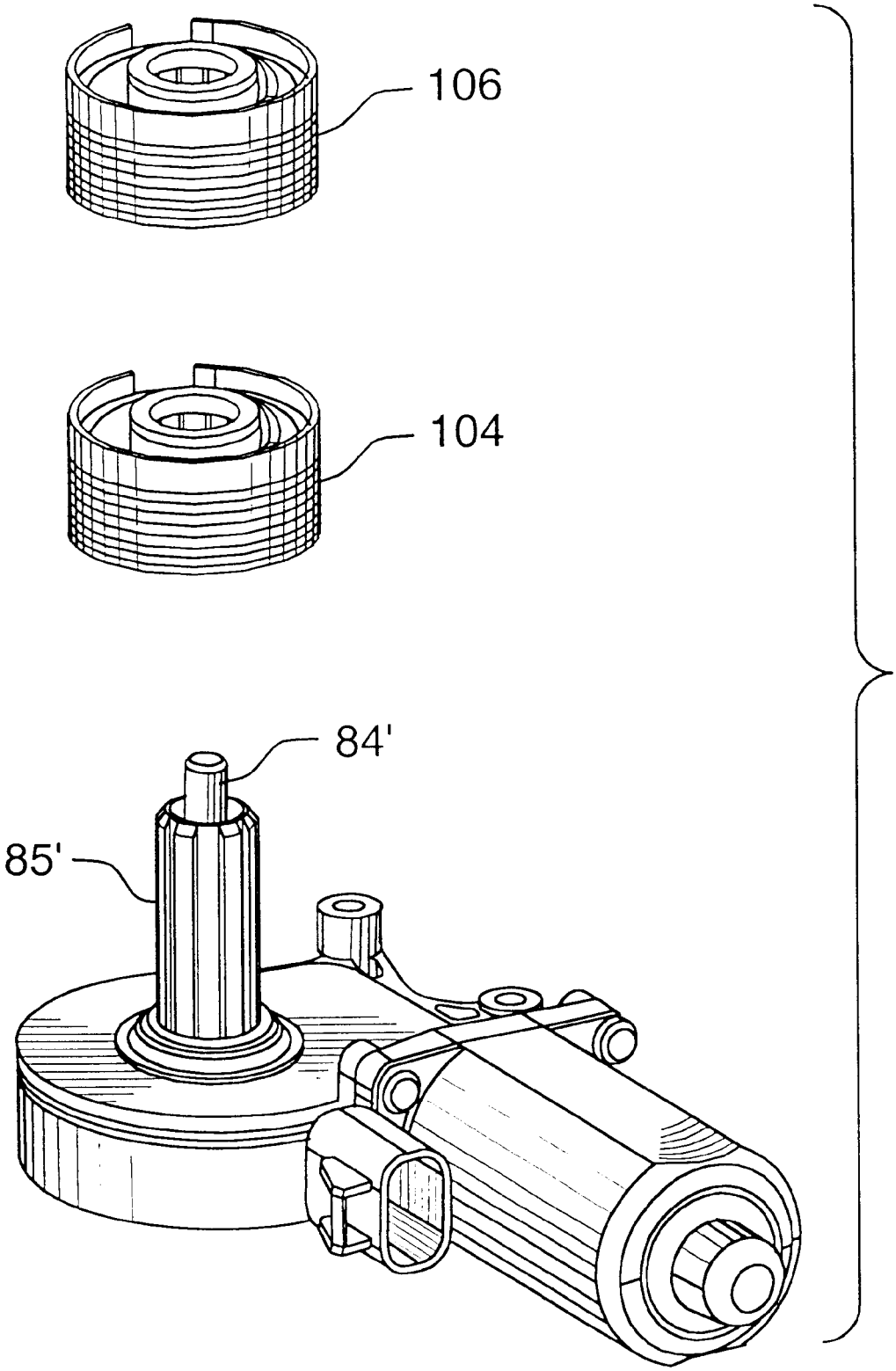
FIG. 7 is an exploded perspective view of a second embodiment of a drive unit of the regulator system of the present invention.

If space within the tailgate 12 permits, barrel portions 104, 105 could be mounted on a common spindle 84' having a spline collar 85' as illustrated in FIG. 7. This arrangement would reduce costs as gear 110 could be eliminated from the design.

It is to be understood that the foregoing specific embodiment has been provided to illustrate the structural and functional principles of the present invention and is not intended to be limiting. To the contrary, the present invention is intended to encompass any alterations, or modifications or alterations within the scope of the appended claims.

We claim:

1. A window regulator system comprising:

a first rail and a second rail, said second rail spaced in parallel in relation with said first rail, a first slider assembly slidably coupled to said first rail, and a second slider assembly slidably coupled to said second rail, a drive unit comprising a first drum assembly and a second drum assembly, a first cable engaging said first slider, said first cable guidedly mounted on said first rail and having opposite ends thereof wound about and fixedly coupled to said first drum assembly, a second cable engaging said second slider, said second cable assembly guidedly mounted on said second rail and having opposite ends thereof wound about and fixedly coupled to said second drum assembly, an actuator operatively engaging both said first and second drum assemblies, whereby energizing said actuator simultaneously effects rotation of said first and second drum assemblies for simultaneously and independently winding and unwinding said first and second cables about said first and second drum assemblies respectively effecting parallel coordinated movement of said first and second sliders along said first and second rails.

2. A window regulator system as claimed in claim 1 wherein said drive unit further comprises a housing, spaced apart first and second spindles supported by said housing, said first drum assembly rotatably mounted on said first spindle and second drum assembly rotatably mounted on said second spindle, said first drum assembly in driving engagement with said actuator and said second drum assembly.

3. A window regulator system as claimed in claim 2 wherein said first drum assembly includes a splined collar in a geared driving relation with said actuator.

4. A window regulator system as claimed in claim 3 wherein said drum assemblies each comprise a barrel portion connected to a gear.

5. A window regulator system as claimed in claim 4 wherein said drive unit further comprises a cover overlying said housing, said cover having a plurality of cable retainers for independently guiding said cables into and out of said housing.

6. A window regulator system as claimed in claim 5 wherein said first cable includes an upper cable having a first end coupled to said first slider and a second opposite end wound around and coupled to said first drum assembly and a lower cable having a first end coupled to said first slider and a second opposite end wound around and coupled to said first drum assembly.

7. A window regulator system as claimed in claim 6 wherein said second cable includes an upper cable having a first end coupled to said second slider and a second opposite end wound around and coupled to said second drum assembly and a lower cable having a first end coupled to said second slider and a second opposite end wound around and coupled to said second drum assembly.

8. A window regulator system comprising:

a first rail and a second rail, said second rail spaced in parallel relation with said first rail, a first slider assembly slidably coupled to said first rail, and a second slider assembly slidably coupled to said second rail, a drive unit comprising a first drum and a second drum, a first cable engaging said first slider, said first cable guidedly mounted on said first rail and having opposite ends thereof wound about and fixedly coupled to said first drum, a second cable engaging said second slider, said second cable guidedly mounted on said second rail and having opposite ends thereof wound about and fixedly coupled to said second drum, an actuator operatively engaging both said first and second drums, whereby energizing said actuator simultaneously effects rotation of said first and second drums for simultaneously and independently winding and unwinding said first and second cables about said first and second drums respectively effecting parallel coordinated movement of said first and second sliders along said first and second rails.

9. A window regulator system as claimed in claim 8 wherein said drive unit further comprises a housing, a first spindle supported by said housing, said first and second drums each rotatably mounted on said first spindle.

10. A window regulator system as claimed in claim 9 wherein said drive unit further comprises a cover overlying said housing, said cover having a plurality of cable retainers for independently guiding said cables into and out of said housing.

11. A window regulator system as claimed in claim 8 wherein said drive unit further comprises a housing, a first spindle support by said housing, said first and second drums are commonly mounted on a splined collar rotatably mounted on said first spindle, said splined collar in a geared driving relation with said actuator.

12. A window regulator system as claimed in claim 11 wherein said drive unit further comprises a cover overlying said housing, said cover having a plurality of cable retainers for independently guiding said cables into and out of said housing.

13. In combination, a window panel slidably mounted for reciprocating movement and a window regulator system comprising:

a first rail and a second rail, said second rail spaced in parallel relation with said first rail, a first slider assembly slidably coupled to said first rail and supporting a first end region of said window panel, and a second slider assembly slidably coupled to said second rail and supporting a second end region of said window panel, a drive unit comprising a first drum assembly and a second drum assembly, a first cable engaging said first slider, said first cable guidedly mounted on said first rail and having opposite ends thereof wound about and fixedly coupled to said first drum assembly, a second cable assembly engaging said second slider, said second cable assembly guidedly mounted on said second rail and having opposite ends thereof wound about and fixedly coupled to said second drum assembly, an actuator operatively engaging both said first and second drum assemblies, whereby energizing said actuator simultaneously effects rotation of said first and second drum assemblies for simultaneously and independently winding and unwinding said first and second cables about said first and second drum assemblies respectively effecting parallel coordinated movement of said window panel and said first and second sliders along said first and second rails.

14. A combination as claimed in claim 13 wherein said drive unit further comprises a housing, spaced apart first and second spindles supported by said housing, said first drum assembly rotatably mounted on said first spindle and second drum assembly rotatably mounted on said second spindle, said first drum assembly in driving engagement with said actuator and said second drum assembly.

15. A combination as claimed in claim 14 wherein said first drum assembly includes a splined collar in a geared driving relation with said actuator.

16. A combination as claimed in claim 15 wherein said drum assemblies each comprise a barrel portion connected to a gear.

17. A combination as claimed in claim 16 wherein said drive unit further comprises a cover overlying said housing, said cover having a plurality of cable retainers for independently guiding said cables into and out of said housing.

18. A window regulator system as claimed in claim 17 wherein said first cable includes an upper cable having a first end coupled to said first slider and a second opposite end wound around and coupled to said first drum and a lower cable having a first end coupled to said first slider and a second opposite end wound around and coupled to said first drum.

19. A window regulator system as claimed in claim 18 wherein said second cable assembly includes an upper cable having a first end coupled to said second slider and a second opposite end wound around and coupled to said second drum and a lower cable having a first end coupled to said second slider and a second opposite end wound around and coupled to said second drum.

* * * * *

UNITED STATES PATENT AND TRADEMARK OFFICE

CERTIFICATE OF CORRECTION

PATENT NO. : 6,430,873 B1
DATED : August 13, 2002
INVENTOR(S) : Borchuk et al.

It is certified that error appears in the above-identified patent and that said Letters Patent is hereby corrected as shown below:

Column 1,
Line 25, delete “are” and insert -- is -- therefor;

Column 2,
Lines 36 and 38, delete “the” and insert -- a -- therefor;
Line 42, delete “a”;
Line 64, delete “to be received to be received” and insert -- to be received -- therefor;

Column 3,
Line 51, delete “communicates” and insert -- communicate -- therefor;
Line 54, delete “th” and insert -- the -- therefor;
Line 62, delete “rotates” and insert -- rotate -- therefor;

Column 4,
Line 23, delete “in”;

Column 5,
Line 49, delete “support” and insert -- supported -- therefor;

Column 6,
Line 3, delete “assembly” after “first slider”;
Line 5, delete “assembly” after “second slider”;
Lines 14 and 15, delete “assemblies”;
Line 31, insert -- said -- before “second”; and
Line 53, delete “assembly”.

Signed and Sealed this

Twenty-fifth Day of February, 2003

JAMES E. ROGAN
*Director of the United States Patent and Trademark Office*